US007671597B2

(12) United States Patent
Finci et al.

(10) Patent No.: US 7,671,597 B2
(45) Date of Patent: Mar. 2, 2010

(54) COMPOSITE ENCASED TOOL FOR SUBSURFACE MEASUREMENTS

(75) Inventors: Bulent Finci, Sugar Land, TX (US); Scott S. Chesser, Richmond, TX (US); Jingjing (Karen) Sun, Missouri City, TX (US); Denis Lebreton, Houston, TX (US); Richard D. Ward, LaPorte, TX (US); Andrei I. Davydychev, Sugar Land, TX (US); William B. Vandermeer, Houston, TX (US); John F. Hunka, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 504 days.

(21) Appl. No.: 11/419,930

(22) Filed: May 23, 2006

(65) Prior Publication Data

US 2007/0107896 A1 May 17, 2007

Related U.S. Application Data

(60) Provisional application No. 60/690,328, filed on Jun. 14, 2005.

(51) Int. Cl.
*G01V 3/00* (2006.01)
*G01V 3/02* (2006.01)

(52) U.S. Cl. ..... 324/347

(58) Field of Classification Search ..... 324/347, 324/332–334, 338, 351, 354, 356, 357; 166/65.1
See application file for complete search history.

(56) References Cited

U.S. PATENT DOCUMENTS 2,725,523 A 11/1955 Doll
3,866,678 A 2/1975 Jeter
4,511,843 A * 4/1985 Thoraval ..... 324/338
4,518,175 A 5/1985 Richards et al.
5,816,344 A 10/1998 Turner
5,862,866 A 1/1999 Springer
6,296,066 B1 10/2001 Terry et al.
6,300,762 B1 10/2001 Thomas, Jr. et al.
6,577,244 B1 * 6/2003 Clark et al. ..... 340/854.6
6,667,620 B2 12/2003 Homan et al.
6,710,600 B1 3/2004 Kopecki et al.
7,023,212 B2 4/2006 Chen et al.
7,026,813 B2 4/2006 Homan et al.
2002/0119271 A1 8/2002 Quigley et al.
2004/0206510 A1 10/2004 Fraser et al.
2005/0167098 A1 8/2005 Lovell et al.

(Continued)

FOREIGN PATENT DOCUMENTS

FR 2618912 2/1989

(Continued)

*Primary Examiner*—Reena Aurora
(74) *Attorney, Agent, or Firm*—Darla P. Fonseca; Jaime Castano

(57) ABSTRACT

A composite encased tool for making subsurface measurements in a borehole traversing a subsurface formation includes a conductive mandrel, a first composite layer wrapped around the conductive mandrel, the first composite layer having one or more slots, a source or sensor disposed in each of the one or more slots, and a second composite layer wrapped around the first composite layer with the source or sensor in the one or more slots.

25 Claims, 4 Drawing Sheets

U.S. PATENT DOCUMENTS

2006/0201717 A1 9/2006 Cramer

FOREIGN PATENT DOCUMENTS

| | | |
|---|---|---|
| GB | 2146127 | 4/1985 |
| GB | 2166828 | 5/1986 |
| GB | 2337546 | 11/1999 |
| WO | WO97/12115 | 4/1997 |
| WO | WO9712166 | 4/1997 |
| WO | WO97/21117 | 6/1997 |
| WO | WO98/45635 | 10/1998 |
| WO | WO9845634 | 10/1998 |
| WO | WO9917045 | 4/1999 |

* cited by examiner

COMPOSITE ENCASED TOOL FOR SUBSURFACE MEASUREMENTS

CROSS-REFERENCE APPLICATION

This application claims priority to U.S. Provisional Application No. 60/690,328, entitled "Composite Shelled Tools for Subsurface Measurements" filed on Jun. 14, 2005, which is hereby incorporated in its entirety.

BACKGROUND OF THE INVENTION

The invention relates generally to methods and apparatus for obtaining formation evaluation logs. More specifically, the invention relates to a body for protecting sources and sensors used in measuring formation properties in a borehole environment.

Various well logging techniques are known in the field of hydrocarbon exploration and production. These techniques typically employ logging instruments or sondes equipped with sources adapted to emit energy through a borehole traversing the subsurface formation. The emitted energy interacts with the surrounding formation to produce signals that are detected and measured by one or more sensors on the instrument. By processing the detected signal data, a profile or log of the formation properties is obtained. Logging techniques known in the art include wireline logging, logging while drilling (LWD), measurement while drilling (MWD), and logging while tripping (LWT). Wireline logging involves lowering the instrument into the borehole at the end of an electrical cable to obtain the subsurface measurements as the instrument is moved along the borehole. LWD/MWD involves disposing the instrument in a drilling assembly for to obtain subsurface measurements while a borehole is drilled through subsurface formation. LWT involves disposing sources or sensors within the drill string to obtain measurements while the drill string is withdrawn from the borehole.

Sources and sensors used in making subsurface measurements are typically disposed in cylindrical sleeves or housings. The housing protects the sources and/or sensors from the borehole environment. For example, U.S. Pat. No. 4,873,488 (assigned to the present assignee) discloses a logging sonde including a support having a generally tubular shape. The support is made of a metal that is preferably non-magnetic and has excellent electrical conductivity. Transmitter and receiver coil units are located along the axis of the support. The coil units are insulated from the metallic material of the support by insulating sleeves. Holes are provided in the support for passage of electrical conductors connected to the coil units. The coils and support are installed in an insulating sleeve made of non-conductive material, such as fiberglass-reinforced epoxy, to protect the coil units from the mud in the borehole. U.S. Pat. No. 7,026,813 (assigned to the present assignee) describes a semi-conductive sleeve for subsurface use.

Throughout the development and advances in subsurface measurements, there continues to be a desire for a robust and inexpensive methodology for protecting sources and/or sensors in a borehole environment.

SUMMARY OF THE INVENTION

In one aspect, the invention relates to a composite encased tool for making subsurface measurements in a borehole traversing a subsurface formation which comprises a conductive mandrel, a first composite layer wrapped around the conductive mandrel, the first composite layer having one or more slots, a source or sensor disposed in each of the one or more slots, and a second composite layer wrapped around the first composite layer with the source or sensor in the one or more slots.

In another aspect, the invention relates to an apparatus for use in a borehole formed in a subsurface formation which comprises a conductive mandrel and a composite body formed on the conductive mandrel. The composite body comprises a first composite layer wrapped around the conductive mandrel an a second composite layer wrapped around the first composite layer. The apparatus further includes an antenna embedded in the composite body. The antenna is adapted to transmit or receive the electromagnetic energy.

In yet another aspect, the invention relates to a method for forming a logging tool for use in a subsurface formation which comprises wrapping a first composite layer around a conductive mandrel, forming a slot in the first composite layer, disposing a source or sensor in the slot formed in the first composite layer, and wrapping a second composite layer around the first composite layer with the source or sensor in the slot.

In another aspect, the invention relates to a system for subsurface measurement in a borehole traversing a subsurface formation which comprises a logging tool comprising a composite encased tool supported in a borehole. The composite encased tool comprises a conductive mandrel, a first composite layer wrapped around the conductive mandrel, the first composite layer having one or more slots, a source or sensor disposed in each of the one or more slots, and a second composite layer wrapped around the first composite layer and over the source or sensor.

Other features and advantages of the invention will be apparent from the following description and the appended claims.

BRIEF DESCRIPTION OF THE DRAWINGS

The accompanying drawings, described below, illustrate typical embodiments of the invention and are not to be considered limiting of the scope of the invention, for the invention may admit to other equally effective embodiments. The figures are not necessarily to scale, and certain features and certain view of the figures may be shown exaggerated in scale or in schematic in the interest of clarity and conciseness.

DETAILED DESCRIPTION

Figure 1A:
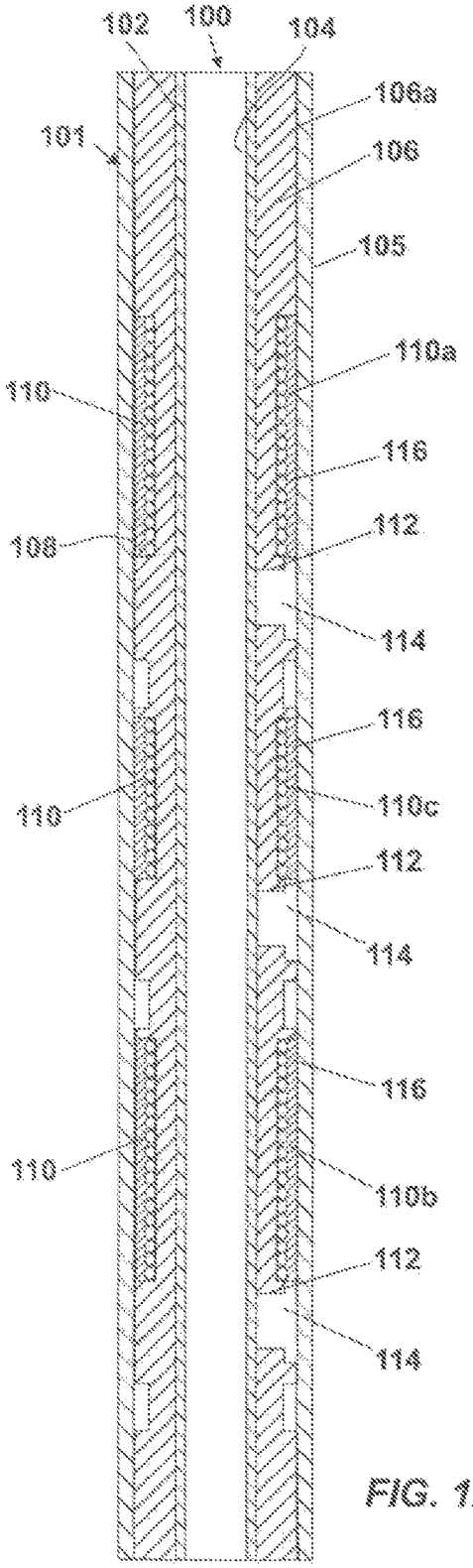
FIG. 1A is a longitudinal cross-section of a composite encased tool having a first composite layer in which one or more sources or sensors are disposed wrapped around a conductive mandrel and a second composite layer wrapped around the first composite layer.

The invention will now be described in detail with reference to a few preferred embodiments, as illustrated in the accompanying drawings. In describing the preferred embodiments, numerous specific details are set forth in order to provide a thorough understanding of the invention. However, it will be apparent to one skilled in the art that the invention may be practiced without some or all of these specific details. In other instances, well-known features and/or process steps have not been described in detail so as not to unnecessarily obscure the invention. In addition, like or identical reference numerals are used to identify common or similar elements.

Figure 1B:
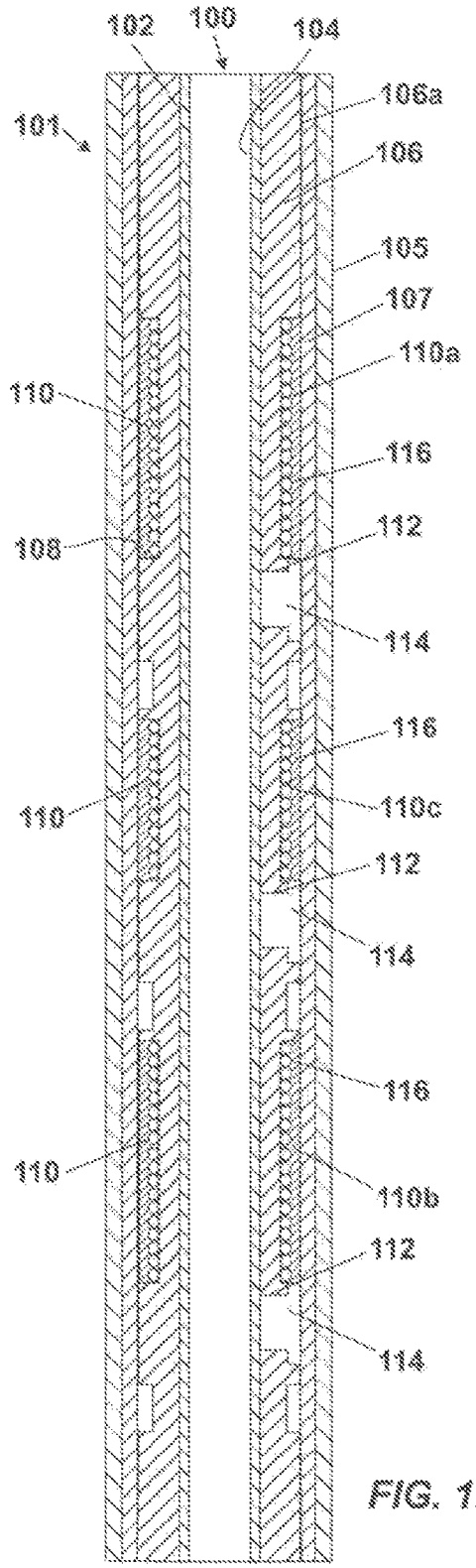
FIG. 1B is a longitudinal cross-section of a composite encased tool having a first composite layer in which one or more sources or sensors are disposed wrapped around a conductive mandrel, a sealant layer formed on the first composite layer, and a second composite layer wrapped around the sealant layer
Figure 1C:
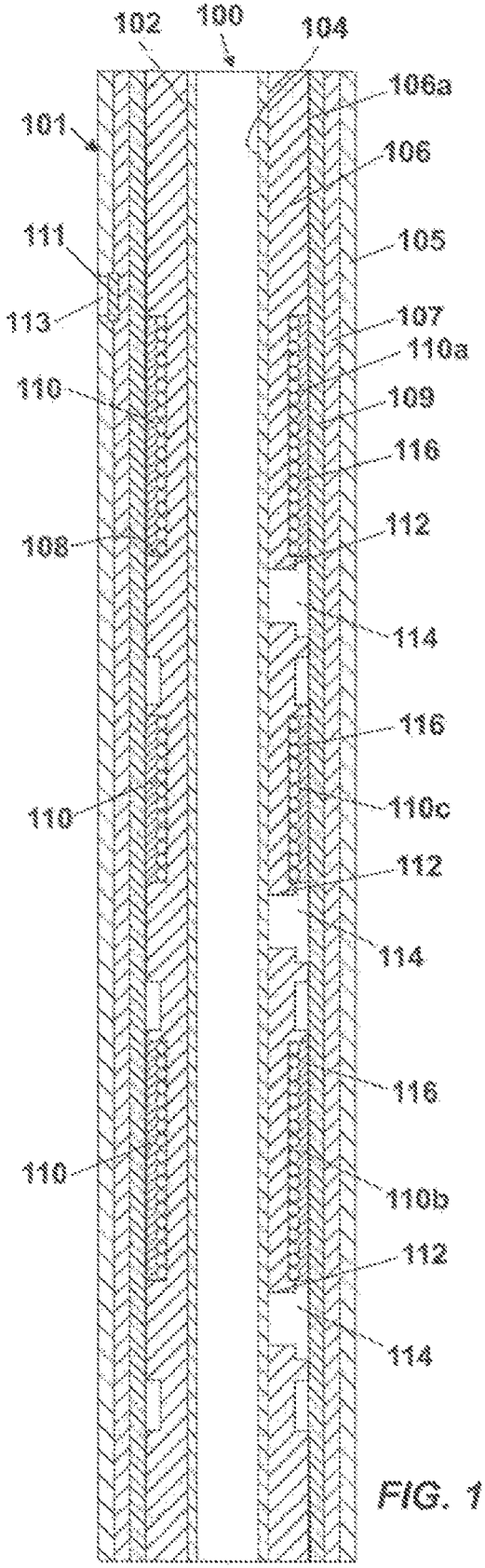
FIG. 1C is a longitudinal cross-section of a composite encase tool having a first composite layer in which one or more sources or sensors are disposed wrapped around a conductive mandrel, a stabilizing composite layer wrapped around the first composite layer, a sealant layer formed on the stabilizing composite layer, and a second composite layer wrapped around the stabilizing composite layer.

FIGS. 1A-1C depict a longitudinal cross-section of a composite encased tool 100 for making subsurface measurements. The composite encased tool 100 includes a composite body 101 formed on a mandrel 102. The mandrel 102 is generally tubular in shape. The mandrel 102 may have a bore 104 for passage of wires and tools, such as fishing tools, or could be solid with slots/grooves along its outer surface for passage of wires. The mandrel 102 is made of a conductive material, typically a metal or an alloy. Preferably, the conductive material is non-magnetic and has good electrical conductivity. In FIG. 1A, the composite body 101 includes a first composite layer 106 formed on the mandrel 102 and a second composite layer 105 formed on the first composite layer 106. In FIG. 1B, the composite body 101 further includes a sealant layer 107 formed between the second composite layer 105 and the first composite layer 106. In FIG. 1C, the composite body 101 further includes a stabilizing composite layer 109 formed between the sealant layer 107 and the first composite layer 106. In all the examples shown in FIGS. 1A-1C, sources/sensors 110 are embedded in the first composite layer 106. In FIG. 1C, electrodes 111 may be interposed between the outer protective layer 105 and the sealant layer 107 and may be exposed to the exterior of the composite encased tool 100 through apertures 113 in the outer protective layer 105. This is useful, for example, for implementations wherein an electrode resistivity tool is running in combination with an electromagnetic tool.

Referring to FIGS. 1A-1C, the first composite layer 106 is wrapped in tension around the mandrel 102 manually or using a suitable wrapping device, such as a lathe machine. The first composite layer 106 may include one or more wrappings of composite material around the mandrel 102. Slots 108 are cut or formed in the first composite layer 106 after wrapping the first composite layer 106 around the mandrel 102. The slots 108 are sized to receive the sources/sensors 110. Holes 112 are also cut in the first composite layer 106 and extend through the wall of the mandrel 102. Typically, a hole 112 is positioned adjacent each slot 108 to allow wires to be passed from the bore 104 of the mandrel 102 to the sources/sensors 110 in the slots 108. The wires in the bore 104 may in turn be connected to an electrical source and/or electronics unit, which may be housed in the bore 104 or otherwise coupled to the mandrel 102. Holes 112 can be sized to receive pressure bulkheads 114. The pressure bulkheads 114 when inserted in the holes 112 seal the bore 104 of the mandrel 102 from the fluid introduced in manufacturing processes and/or borehole fluid. If bore 104 can be filled with fluid, pressure bulkhead 114 can be attached to the ends of the mandrel 102 to prevent the fluid from flooding the electronics. The first composite layer 106 may be made of any suitable composite material. Preferably, the composite material can be machined to form the slots 108 and holes 112 in the first composite layer 106. Examples of composite materials include, but are not limited to, fiber-resin composite, polyaryletherketone, such as polyetheretherketone and polyetherketone, and filament wound glass.

A variety of conventional sources/sensors 110 may be disposed in the slots 108 to obtain a variety of measurements. The number of slots 108, the number of sources/sensors 110, and the arrangement of the sources/sensors 110 would depend on the type of subsurface measurement being made using the sources/sensors 110. For electromagnetic (EM) tools, the sources/sensors 110 may be antennas. The antennas may be solenoid-type coil antennas, loop antennas, or any coil construction resulting in a longitudinal magnetic dipole (LMD) or transverse magnetic dipole (TMD) as known in the art. An antenna may have one or more coils. LMD antennas typically have one coil, while some TMD antennas may have multiple coils. Where the sources/sensors 110 are solenoid-type coils, the slots 108 may be circumferential slots and the coils may be disposed in the slots 108 by winding the coils directly on and around the circumference of the first composite layer 106 within the slots 108 using, for example, a coil winding machine. Corresponding to an induction tool, a transmitter antenna coil 110*a* and a receiver antenna coil 110*b* are disposed in two of the slots 108. A bucking antenna coil 110*c* may also be disposed in one of the slots 108, near the transmitter antenna coil 110*a* or the receiver antenna coil 110*b*, to eliminate direct transmitter-to-receiver coupling. The transmitter antenna 110*a* transmits electromagnetic energy when energized, while the receiver antenna 110*b* receives electromagnetic energy which has been modified by the surrounding formation or borehole.

Filler material 116 may be added to the slots 108 to lock the sources/sensors 110 in place and eliminate air pockets that may be trapped underneath the sources/sensors 110 in the slots 108. The filler material 116 may be a curable material such as resin. The filler material 116 may be disposed in the slots 108 such that the filler material 116 is flush with the outer surface 106*a* of the first composite layer 106. This may include first overfilling the slots 108 with the filler material 116 and then machining down or otherwise filing away the filler material 116. In one example, as illustrated in FIG. 1C, the stabilizing composite layer 109 is then formed or wrapped directly on or around the first composite layer 106, over the slots 108 and the holes 112. The stabilizing composite layer may have one or more wrappings of a composite material. The sealant layer 107 may be formed directly on the stabilizing composite layer 109 or, where the stabilizing composite layer 109 is absent, directly on the first composite layer 106. The second composite layer 105 may be formed or wrapped directly on or around the sealant layer 107 or, where the sealant layer 107 is absent, directly on the first composite layer 106. The second composite layer 105 may have one or more wrappings of a composite material.

The stabilizing composite layer 109 may be made of any composite material suitable for use in a borehole environment. Examples of composite materials include, but are not limited to, fiber-resin composite and polyaryletherketone, such as polyetheretherketone and polyetherketone. The sealant layer 107 may be made of an elastomer or a rubber material. Examples of materials for the sealant layer 107 include, but are not limited to, Neoprene (RTM), Viton (RTM), and Nitrile (RTM). The sealant layer 107 prevents borehole fluids from entering the slots 108 and reaching the sources/sensors 110. The stabilizing composite layer 109 when present provides a stabilizing layer for the sealant layer 107. For example, the stabilizing composite layer 109 may prevent the sealant layer 107 from collapsing into the slots in cases where air pockets are not completely eliminated from the slots 108. The second composite layer 105 may also be made of suitable composite material. In one example, the second composite layer 105 is made of fiber-resin composite. In another example, the second composite layer 105 includes one or more layers of fabric, e.g., glass cloth or graphite cloth, impregnated with resin.

Figure 2A:
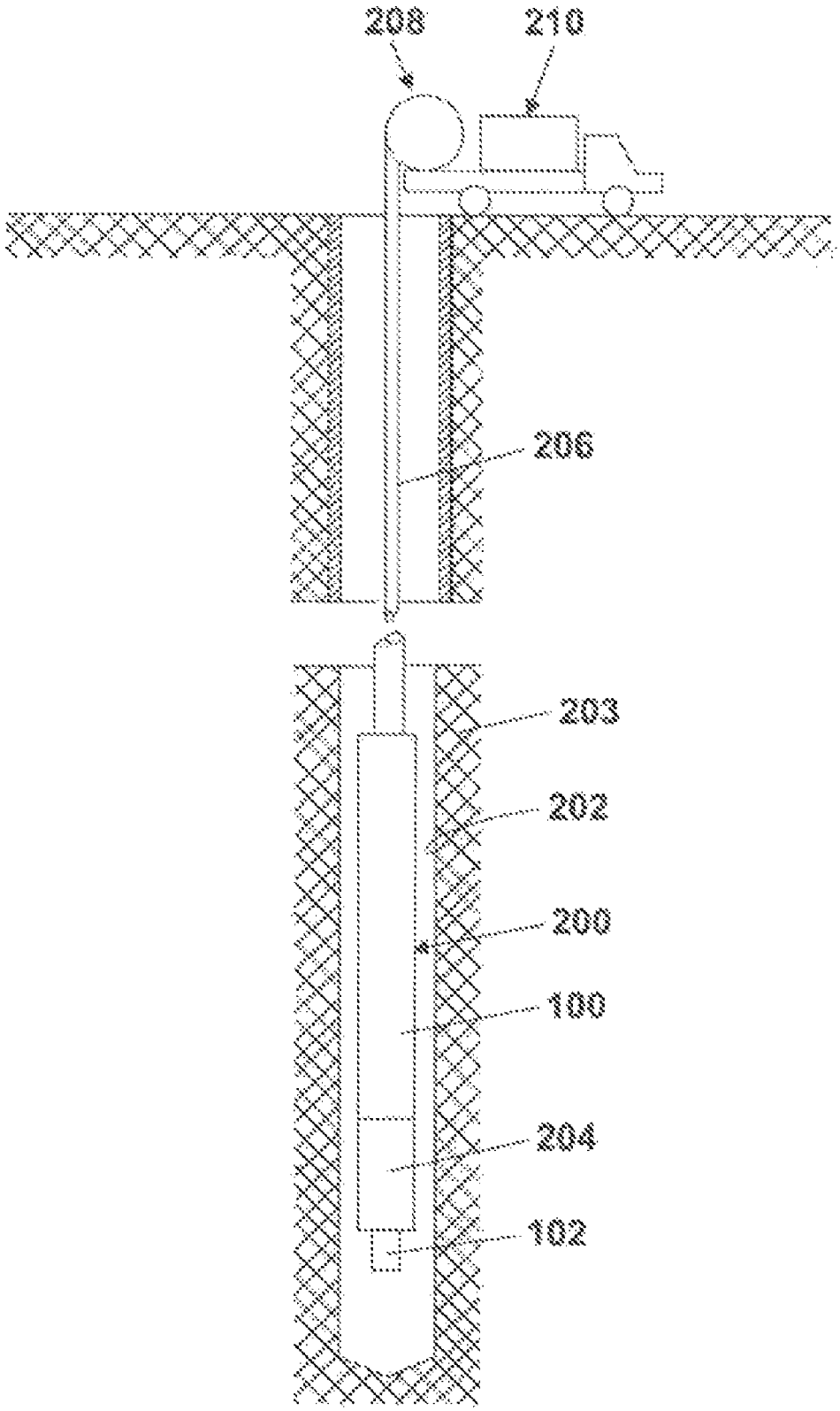
FIG. 2A shows the composite encased tool of any one of FIGS. 1A-1C supported in a borehole by a wireline.
Figure 2B:
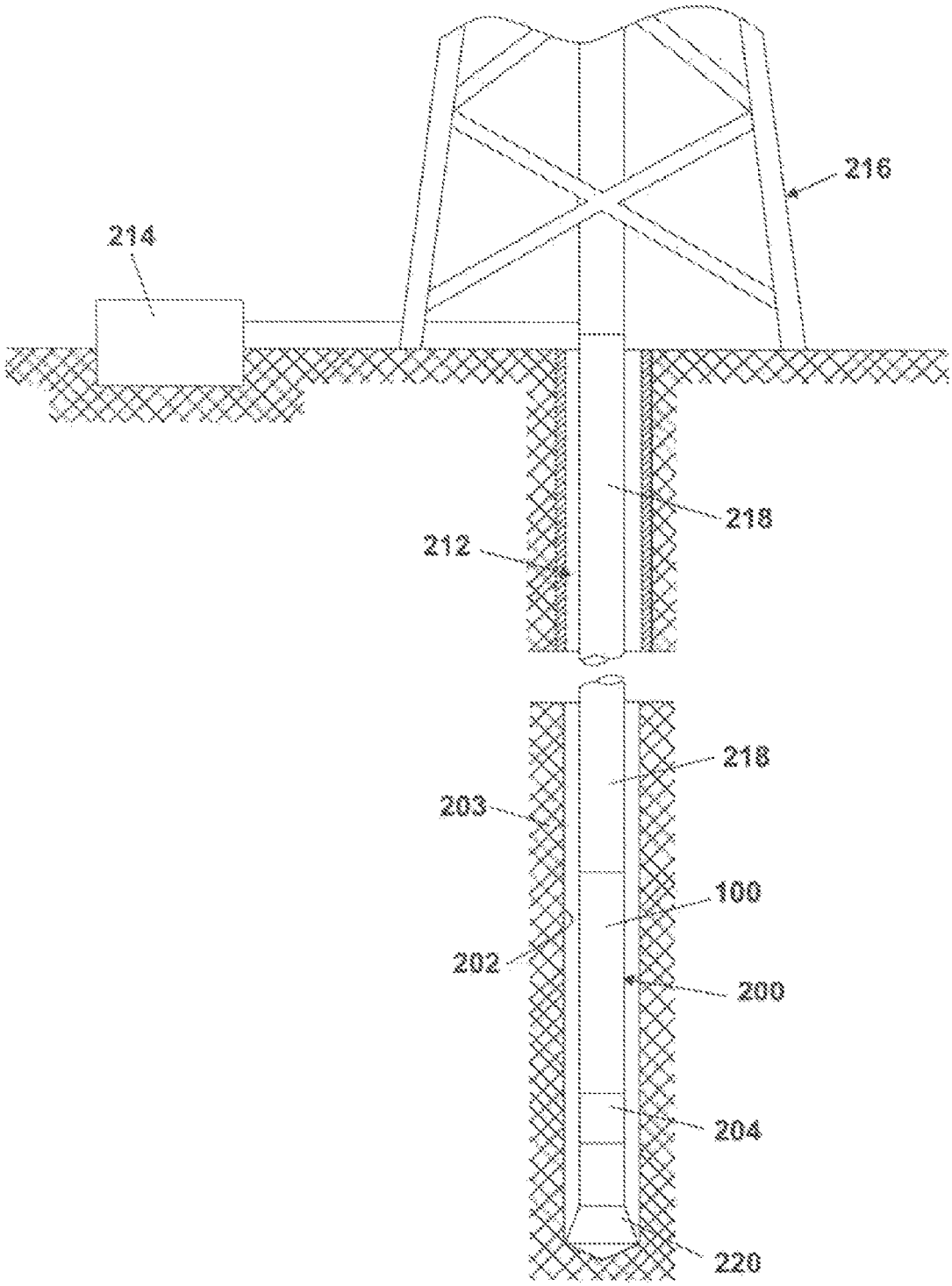
FIG. 2B shows the composite encased tool of any one of FIGS. 1A-1C supported in a borehole by a drill string.

FIGS. 2A and 2B depict a logging tool 200 disposed on a borehole 202 formed in subsurface formation 203. The logging tool 200 includes the composite encased tool 100. The logging tool 200 also includes one or more electronics units 204 coupled to the composite encased tool 100. Electronics unit 204 may be disposed below and/or above the composite encased tool 100. Electronics unit 204 may control the sources/sensors (110 in FIGS. 1A-1C) in the composite encased tool 100 and generate signals from the output of the sensors, which signals are representative of the properties of the formation or borehole being measured. The logging tool 200 may be supported in the borehole 202 using any suitable support device, such as a wireline, drill string, or coiled tubing. In FIG. 2A, the logging tool 200 is supported in the borehole 202 by a wireline or slickline 206. In the wireline example, the wireline 206 is raised up and lowered into the borehole 202 by a winch 208, which is controlled by surface equipment 210. The wireline 206 includes conductors that connect the electronics unit 204 to the surface equipment 210. Signals generated at the electronics unit 204 may be communicated to the surface equipment 210 through the wireline 206 for processing. In FIG. 2B, the logging tool 200 is incorporated in a drill string 212. The drill string 212 extends from a drilling rig 216 into the borehole 202. The drill string 212 includes pipe joints 218, which are coupled together and to the logging tool 200. The drill string 212 also includes a drill bit 220 near the logging tool 200. Signals from the logging tool 200 may be communicated to a surface unit 214 via mud pulse telemetry or through conductors in the drill string 212. These and other conventional methods and systems for communicating signals from a downhole tool to a surface unit may be used.

While the invention has been described with respect to a limited number of embodiments, those skilled in the art, having benefit of this disclosure, will appreciate that other embodiments can be devised which do not depart from the scope of the invention as disclosed herein. For example, embodiments of the invention may be implemented with various types of sources/sensors as known in the art (e.g., temperature, pressure, gravity, nuclear, acoustic, microphone sensors, etc.). It will also be understood by those skilled in the art that embodiments of the invention may be implemented with the various EM antenna configurations as known in the art and activated to transmit/receive at any desired frequency or frequency range (e.g., for propagation or induction type measurements).

What is claimed is:

1. A composite encased tool for making subsurface measurements in a borehole traversing a subsurface formation, comprising:

a conductive mandrel;

a first composite layer wrapped around the conductive mandrel, the first composite layer having one or more slots;

a source or sensor disposed in each of the one or more slots;

a second composite layer wrapped around the first composite layer with the source or sensor in the one or more slots; and a sealant layer interposed between the first composite layer and the second composite layer.

2. The composite encased tool of claim 1, wherein the sealant layer comprises a rubber or elastomer material.

3. The composite encased tool of claim 1, further comprising a stabilizing composite layer interposed between the first composite layer and the sealant layer.

4. The composite encased tool of claim 1, wherein one or more electrodes are disposed between the sealant layer and the second composite layer.

5. The composite encased tool of claim 4, wherein the one or more electrodes are exposed through one or more apertures formed in the second composite layer.

6. The composite encased tool of claim 1, further comprising one or more pressure bulkheads coupled to the conductive mandrel.

7. The composite encased tool of claim 6, further comprising one or more holes extending from the first composite layer into the conductive mandrel for receiving the one or more pressure bulkheads.

8. The composite encased tool of claim 1, wherein the source or sensor comprises one or more coils.

9. The composite encased tool of claim 8, wherein the one or more slots are circumferential slots and the one or more coils are wound on the first composite layer within the one or more slots.

10. The composite encased tool of claim 1, further comprising filler material disposed in the one or more slots, thereby locking the source or sensor disposed in the one or more slots in place.

11. The composite encased logging tool of claim 1 wherein said conductive mandrel is made from a metal or alloy.

12. An apparatus for use in a borehole formed in a subsurface formation, comprising:

a conductive mandrel;

a composite body formed on the conductive mandrel, the composite body comprising a first composite layer wrapped around the conductive mandrel and a second composite layer wrapped around the first composite layer;

an antenna embedded in the composite body, the antenna adapted to transmit or receive electromagnetic energy;

a sealant layer interposed between the first composite layer and the second composite layer.

13. The apparatus of claim 12, further comprising an electronics unit which controls operation of the antenna.

14. The apparatus of claim 12, further comprising a stabilizing composite layer interposed between the first composite layer and the sealant layer.

15. The apparatus of claim 12, wherein one or more electrodes are disposed between the sealant layer and the second composite layer.

16. A method for forming a logging tool for use in a subsurface formation, comprising:

wrapping a first composite layer around a conductive mandrel;

forming a slot in the first composite layer;

disposing a source or sensor in the slot formed in the first composite layer;

wrapping the first composite layer in a sealant layer; and wrapping a second composite layer around the sealant layer with the source or sensor in the slot.

17. The method of claim 16, further comprising filling the slot with a filler material after disposing the source or sensor in the slot and before wrapping the second composite layer on the first composite layer.

18. The method of claim 17, wherein the filler material is a curable material and further comprising curing the filler material before wrapping the second composite layer on the first composite layer.

19. The method of claim 16, further comprising wrapping the first composite layer in a stabilizing composite layer prior to wrapping the first composite layer in a sealant layer such that the stabilizing layer is disposed between the first composite layer and the sealant layer.

20. The method of claim 16, further comprising disposing one or more electrodes between the sealant layer and the second composite layer.

21. The method of claim 20, further comprising forming one or more apertures in the second composite layer to expose the one or more electrodes.

22. A system for subsurface measurement in a borehole traversing a subsurface formation, comprising:

a logging tool comprising a composite encased tool supported in a borehole;

wherein the composite encased tool comprises a conductive mandrel, a first composite layer wrapped around the conductive mandrel, the first composite layer having one or more slots, a source or sensor disposed in each of the one or more slots, a second composite layer wrapped around the first composite layer and over the source or sensor and a sealant layer interposed between the first composite layer and the second composite layer.

23. The system of claim 22, further comprising a stabilizing composite layer interposed between the first composite layer and the sealant layer.

24. The system of claim 23, further comprising one or more electrodes disposed between the sealant layer and the second composite layer.

25. The system of claim 22 wherein said conductive mandrel is made from a metal or alloy.

* * * * *